United States Patent [19]

Bangay et al.

[11] Patent Number: 4,557,894

[45] Date of Patent: Dec. 10, 1985

[54] FRICTION-ACTUATED EXTRUSION

[75] Inventors: Alan J. Bangay, New Malden; Adrian Cole, Maidenhead; John S. Vernon, Ealing, all of England

[73] Assignee: BICC Public Ltd., Co., London, England

[21] Appl. No.: 706,525

[22] Filed: Feb. 28, 1985

Related U.S. Application Data

[63] Continuation of Ser. No. 551,936, Nov. 15, 1983, abandoned.

[30] Foreign Application Priority Data

Nov. 25, 1982 [GB] United Kingdom ..... 8233615
Jan. 10, 1983 [GB] United Kingdom ..... 8300536

[51] Int. Cl.[4] ..... B22F 3/02

[52] U.S. Cl. ..... 419/67; 72/39; 72/262; 72/270; 419/63; 204/141.5

[58] Field of Search ..... 204/141.5; 72/39, 262, 72/270; 419/63, 67

[56] References Cited

U.S. PATENT DOCUMENTS

| | | | |
|---|---|---|---|
| 3,537,895 | 11/1970 | Lancy | 134/3 |
| 3,649,194 | 3/1972 | Glanville | 23/207.5 |
| 3,933,961 | 1/1976 | Burns | 419/63 |
| 4,110,892 | 9/1978 | Bangay et al. | 29/420 |
| 4,397,622 | 8/1983 | Childs et al. | 419/67 |
| 4,419,324 | 12/1983 | Childs et al. | 419/67 |
| 4,484,876 | 11/1984 | Childs et al. | 419/67 X |
| 4,505,878 | 3/1985 | Childs et al. | 419/67 X |

FOREIGN PATENT DOCUMENTS

| | | | |
|---|---|---|---|
| 0094258 | 11/1983 | European Pat. Off. . | |
| 166306 | 12/1981 | Japan | 419/67 |
| 698717 | 10/1953 | United Kingdom . | |
| 1157038 | 7/1969 | United Kingdom . | |
| 1370894 | 10/1974 | United Kingdom . | |
| 2000191 | 1/1979 | United Kingdom . | |
| 2021986 | 12/1979 | United Kingdom . | |
| 2069389B | 4/1983 | United Kingdom . | |

OTHER PUBLICATIONS

Moenes L. Elias, "Pickling Copper and its Alloys with $H_2SO_4$ Mixtures", *Metal Progress*, Jun. 1981, pp. 36, 38 and 1 page of drawings.

*Primary Examiner*—Stephen J. Lechert, Jr.
*Attorney, Agent, or Firm*—Parkhurst & Oliff

[57] ABSTRACT

A friction-actuated extrusion process comprising pickling the metal to be extruded before it is granulated and used as the in-feed for the process.

9 Claims, No Drawings

FRICTION-ACTUATED EXTRUSION

This is a continuation of application Ser. No. 551,936 filed Nov. 15, 1983 now abandoned.

This invention relates to the friction-actuated extrusion of metal.

By "friction-actuated" extrusion is meant a process comprising the steps of feeding metal into one end of a passageway formed between first and second members with the second member having a greater surface area for engaging the metal than the first member, the passageway having an obstruction at the end remote from the end into which the metal is fed and having at least one die orifice associated with the obstructed end, moving the passageway-defining surface of the second member relative to the passageway-defining surface of the first member in the direction towards the die orifice from the first end to the obstructed end, frictional drag of the passageway-defining surface of the second member drawing the metal through the passageway and generating in it a pressure that is sufficient to extrude it through the die orifice. The obstructed end of the passageway may be blocked substantially entirely, as described in British Patent Specification No. 1370894 (United Kingdom Atomic Energy Authority) but when, as in the most usual practice (the Conform process) the passageway is arcuate and the second member is a wheel with a groove formed in its surface into which the first member projects and the obstructed end is defined by an abutment projecting from the first member, we prefer that the abutment member is of substantially smaller cross-section than the passageway so that it leaves a substantial gap between the abutment member and the groove surface. In this case metal can adhere to the groove surface, as described in the specification of our granted UK Pat. No. 2,069,389B, whereby a portion of the metal extrudes through the clearance and remains as a lining in the groove to reenter the passageway at the entry end while the remainder of the metal extrudes through the die orifice.

The Conform process was originally developed for the extrusion of metal rod in-feed. It is now known to provide an in-feed in the form of granules. One of the steps during the preparation of the granular in-feed material is the removal of oxide and other surface contaminations from the metal granules. We have experimented by treating (pickling) the granules with a suitable chemical or chemicals. The oxide layer and other contaminations need to be removed because their presence can result in failure at the particle boundaries (interparticle separation) and/or blistering of the surface of the extruded material. We have found that pickling the granules will not, however, necessarily prevent blistering as surface contamination of the metal before granulating can become entrained into the metal during granulation, and will not therefore be removed by pickling.

In accordance with the invention, therefore, a friction-actuated extrusion process is distinguished by pickling the metal before it is granulated and used as the in-feed for the process.

Preferably after pickling the metal is kept below a temperature at which significant oxidation or other film contamination (e.g. sulphides) of the metal may occur. After pickling the metal is preferably stored in a protective (inert) atmosphere. Further, the metal is preferably granulated in a protective (inert) atmosphere.

Using this arrangement it has been found that the previous disadvantage of blistering of the metal surface has been overcome.

The granulated metal may, additionally, be pickled before it is extruded.

This invention has particular advantages over the prior art when the metal is copper. In this case the copper is in the form of a cathode before granulating, and it is the cathode which is pickled. After pickling the cathode is preferably washed in distilled or de-ionised water. The cathode is preferably dried, stored and granulated below 80° Centigrade, and preferably in an inert or reducing atmosphere. Obviously any form of handling or storing of the cathode after pickling which is likely to lead to contamination (e.g. by grease, dust, dirt, etc) of the cathode is preferably avoided.

Any suitable pickling solution may be used. In the case of copper, the pickling solution preferably comprises a mixture of suphuric acid, hydrogen peroxide and water. The hydrogen peroxide provides extra oxygen to assist in the dissolution by the acid of copper (1) oxide by oxidation to copper (11) sulphate.

Other suitable pickling solutions include 10% hydrochloric acid; 10% sulphuric acid; 25% sulphuric acid with 1.5% sodium bichromate; 50% sulphuric acid with 25% nitric acid; or 8% tartaric acid.

EXAMPLE 1

A copper cathode was granulated in a granulator as described in our published European patent application No. 94258 to an approximate size of 3 mm and used as the in-feed for a Conform machine as described in UK Pat. No. 2,069,389B using an extrusion ratio of approximately 20:1. The copper wire that was subsequently extruded blistered during extrusion. Further, the wire that was extruded showed severe inter-particle separation during torsion, bend and tensile tests.

Another copper cathode was granulated as above, pickled in 10% sulphuric acid and 3% hydrogen peroxide at 40° C. for one hour, rinsed, washed, dried and then used as the in-feed for a Conform machine under the same conditions as above. The copper wire that was subsequently extruded blistered during extrusion, but showed no significant signs of inter-particle separation during torsion, bend and tensile tests until after annealing for one hour at 400° to 500° C.

A further copper cathode was vapour degreased and then pickled in a dilute solution comprising 10% suphuric acid and 3% hydrogen peroxide at 40°–45° C. for approximately 5 minutes. The cathode was then washed in de-ionised water and blow dried before being granulated and fed into a Conform machine under the same conditions as above. The copper wire that was extruded showed no signs of blistering or significant inter-particde separation, until after heating for one hour at 400° to 500° C. Some of the copper cathode was granulated in a nitrogen atmosphere and the resulting wire extruded under the same conditions withstood annealing at 600° Centigrade for one hour without showing signs of blistering or interparticle separation. At all times during the preparation of the pickled cathode the temperature of the copper was kept below 80° C.

Using this invention, it is therefore possible to produce extruded copper wire from granular infeed which has not been heat treated, and which can be extruded without blistering.

What we claim as our invention is:

1. A process of friction-actuated extrusion of copper comprising pickling cathode copper, granulating the pickled copper, and feeding the pickled, granulated copper into a continuous friction-actuated extrusion apparatus.

2. A process as claimed in claim 1, wherein after pickling, the copper is kept below a temperature at which significant oxidation or other film contamination occurs.

3. A process as claimed in claim 1, wherein after pickling, the copper is stored in a protective atmosphere.

4. A process as claimed in claim 1, wherein the copper is granulated in a protective atmosphere.

5. A process as claimed in claim 1, wherein the copper is additionally pickled after granulating.

6. A process as claimed in claim 1, wherein the pickling solution comprises a mixture of sulphuric acid, hydrogen peroxide and water.

7. A process as claimed in claim 1, wherein, after the cathode is pickled, it is washed in distilled or deionized water.

8. A process as claimed in claim 7, wherein the washed cathode is dried, stored and granulated below 80° C.

9. A process as claimed in claim 8, wherein the cathode is dried, stored and granulated in an inert or reducing atmosphere.

* * * * *